US007380502B2

(12) United States Patent
Emary

(10) Patent No.: US 7,380,502 B2
(45) Date of Patent: Jun. 3, 2008

(54) RIFLE CARTRIDGE WITH BULLET HAVING RESILIENT POINTED TIP

(75) Inventor: David E. Emary, St. Paul, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 115 days.

(21) Appl. No.: 11/130,976

(22) Filed: May 16, 2005

(65) Prior Publication Data

US 2006/0278117 A1 Dec. 14, 2006

(51) Int. Cl.
*F42B 12/34* (2006.01)
*F42B 30/02* (2006.01)

(52) U.S. Cl. ..... 102/506; 102/508

(58) Field of Classification Search ..... 102/501, 102/506–510

See application file for complete search history.

(56) References Cited

U.S. PATENT DOCUMENTS

| | | | | | |
|---|---|---|---|---|---|
| 1,004,510 | A * | 9/1911 | Watson | 102/508 |
| 1,134,797 | A * | 4/1915 | Wood | 102/508 |
| 1,155,901 | A * | 10/1915 | Duncan | 102/508 |
| 1,493,614 | A * | 5/1924 | Dickerman | 102/510 |
| 3,911,820 | A * | 10/1975 | Canon | 102/438 |
| 3,972,286 | A * | 8/1976 | Canon | 102/438 |
| 4,044,685 | A * | 8/1977 | Avcin | 102/508 |
| 4,245,557 | A * | 1/1981 | Knappworst et al. | 102/508 |
| 5,440,994 | A * | 8/1995 | Alexander | 102/439 |
| 5,454,325 | A * | 10/1995 | LeBlanc | 102/506 |
| 5,760,329 | A * | 6/1998 | Baum et al. | 102/439 |
| 6,363,856 | B1 * | 4/2002 | Stoker et al. | 102/516 |
| 6,526,893 | B2 * | 3/2003 | May et al. | 102/508 |
| 6,782,828 | B2 * | 8/2004 | Widener | 102/502 |
| 6,792,869 | B2 | 9/2004 | Pi | |
| 6,971,315 | B2 * | 12/2005 | Knappworst et al. | 102/510 |
| 2005/0241523 | A1 * | 11/2005 | Schikora et al. | 102/510 |

* cited by examiner

*Primary Examiner*—Bret Hayes
(74) *Attorney, Agent, or Firm*—Langlotz Patent Works, Inc.; Bennet K. Langlotz

(57) ABSTRACT

A firearm cartridge with a bullet including a body and a nose element. The body has a forward end, and an opposed rear end, with an intermediate cylindrical portion between the ends. The front end of the body defines a cavity that may have a cylindrical shape. The nose element is formed of a resilient material such as an elastomer, and has a first portion received in the cavity, and a pointed second portion extending from the forward end of the body. The bullet may be received in a centerfire rifle casing, for safe use in a tubular magazine rifle, so that the resilient tip protects against discharge of an adjacent cartridge primer by absorbing energy of recoil or other impulse. The second portion of the tip has a small meplat, and is smoothly contoured with the exterior surface of the front of the bullet, to provide an increased ballistic coefficient.

20 Claims, 4 Drawing Sheets

RIFLE CARTRIDGE WITH BULLET HAVING RESILIENT POINTED TIP

FIELD OF THE INVENTION

This invention relates to firearms ammunition, and more particularly to cartridges and bullets for use in rifles with tubular magazines.

BACKGROUND AND SUMMARY OF THE INVENTION

Many popular types of rifles such as lever action rifles employ tubular magazines, in which a single line of cartridges is stored in a cylindrical tube parallel to and just below the rifle barrel. The cartridges are arranged nose first, with a compressed spring and piston forward of the nose of the forward most cartridge. The spring pressure transmits through the row of cartridges, and forces the rear most cartridge into the action when the action is cycled.

Because the nose of each cartridge in the tube presses against the rear of the next cartridge, this raises a critical safety concern. Centerfire cartridges have primers centered on the base of the cartridge, and it is essential to ensure that the nose of one bullet does not act like a firing pin that strikes the primer of the next bullet. Such forces can occur if a rifle is dropped, such as from an elevated tree stand, or from recoil upon discharge. Thus, sharply pointed bullets common to other types of rifles employing box magazines (in which the cartridges are positioned side-by-side) are not suitable for tube-magazine rifles.

Rifles with tubular magazines are limited to rimfire cartridges (which do not have a central primer and require a sharp pinching of the rim to discharge) and to centerfire cartridges having broad flat noses. Blunt, rounded nose bullets have been employed, but these are regarded as more risky than flat nosed bullets. Typically, the flat nose of a suitable bullet has a diameter of approximately 60% or greater than that of the primer. This ensures any force transmitted to the primer is distributed over a large enough area to ensure that primer discharge will not occur. Cartridges with heavier bullets generally have larger diameter flat noses, to account for the increased force that the added mass of a stack of cartridges can generate upon dropping a loaded rifle, and the increased recoil associated with such cartridges. The noses of such bullets are generally formed of exposed lead and are not fully jacketed to provide further safety.

While effective to ensure safety, flat nosed or other blunt bullets are aerodynamically inefficient compared to the sharply pointed bullets used in other rifles. This means that they lose more velocity as a function of distance traveled than a sharp pointed bullet, due to increased air resistance. This effect is greatest over longer distances. Because of this higher rate of velocity loss blunt bullets carry less energy downrange than do pointed bullets. In addition, the reduced velocity at distance leads to greater bullet drop and crosswind drift, requiring more compensation by and opportunity for error from the shooter.

A suitable safe, blunt bullet for a tubular rifle magazine will generally have a ballistic coefficient (BC) of approximately 0.200 depending on the caliber and weight of the bullet. Sharply pointed bullets, of comparable caliber and weight, have BC values typically of 0.250 to 0.350. Thus, a lever action rifle chambered in 30-30 Winchester is considered effective for deer hunting only out to about 100-150 yards, while cartridges with spire-point bullets of comparable weight and muzzle velocities are effective for deer beyond 250 yards.

The present invention overcomes the limitations of the prior art by providing a firearm cartridge with a bullet including a body and a nose element. The body has a forward tapered end, and an opposed flat or tapered rear end, with an intermediate cylindrical portion between the ends. The front end of the body defines a cavity that may have a cylindrical shape. The nose element is formed of a resilient elastomer material, and has a first portion received in the cavity, and a pointed second portion extending from the forward end of the body, smoothly contoured with the exterior surface of the front of the bullet, which provides an increased ballistic coefficient. The bullet can be placed in a centerfire rifle casing, and the resulting cartridge loaded in a tubular rifle magazine. The resilient tip protects against discharge of an adjacent cartridge primer by absorbing energy of recoil or other impulse.

DETAILED DESCRIPTION OF A PREFERRED EMBODIMENT

Figure 1:
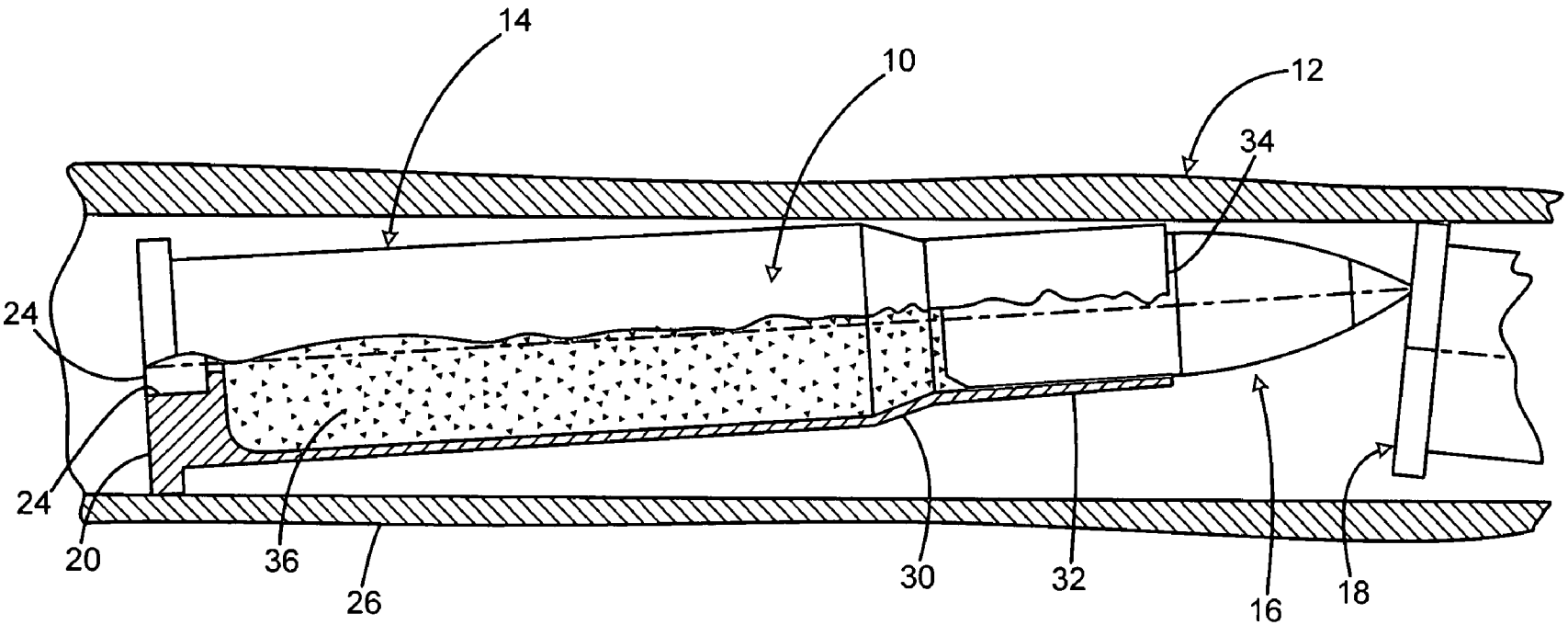
FIG. 1 is a sectional side view of a rifle cartridge according to a preferred embodiment of the invention.
Figure 2:
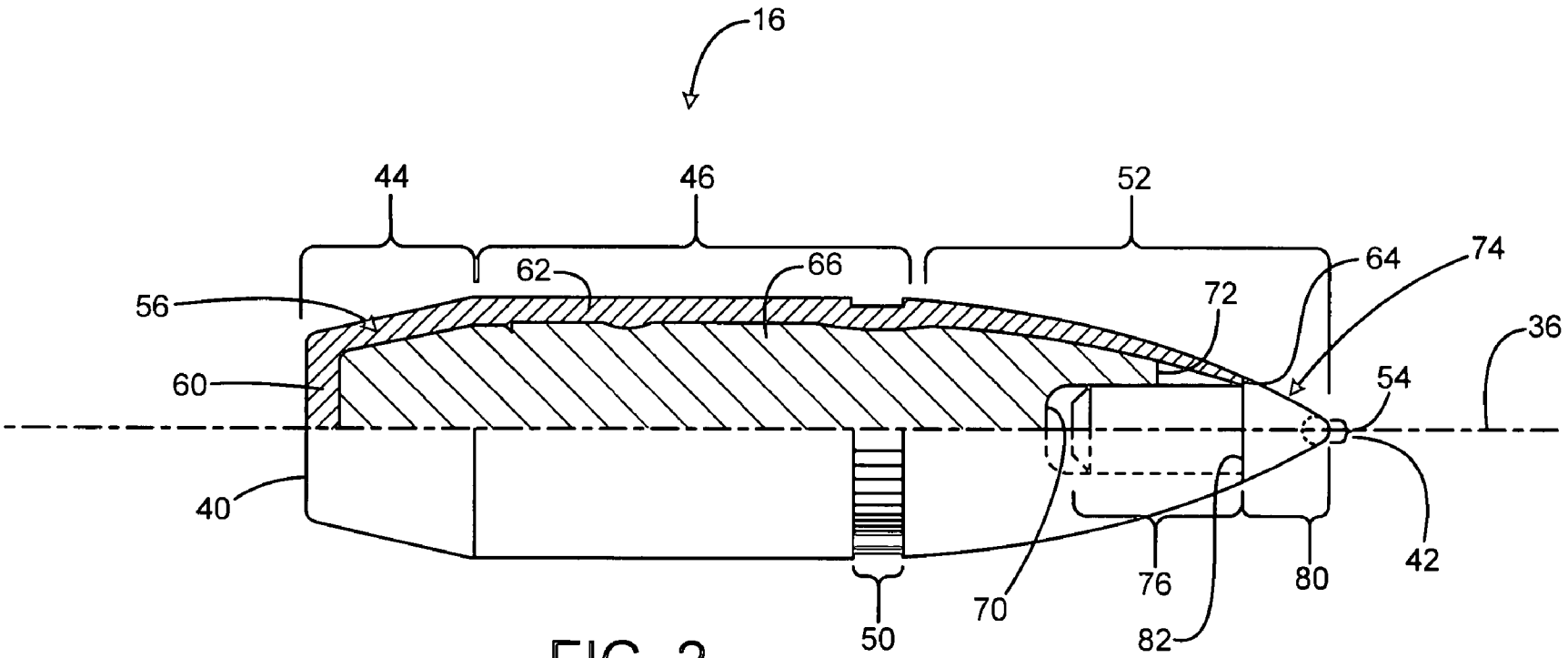
FIG. 2 is a sectional side view of a bullet according to a preferred embodiment of the invention.

FIG. 1 shows a rifle cartridge 10 as loaded in a tubular magazine 12 typically attached below the barrel of a lever-action rifle. The cartridge has brass case 14, and a bullet 16. The case has a circular rear end 20 defining a central pocket 24 into which is inserted a primer. The case has side walls 26, and can have a tapered shoulder 30 leading to a reduced diameter neck, or nearly straight sidewalls that end in a forward case mouth 34. The case contains a quantity of powder 36, which is contained by the bullet 16 being partially inserted into the mouth, which is crimped to secure the bullet in place. The rear of a second cartridge 18 is shown, positioned just forward of the cartridge, illustrating how in many instances, the tip of one bullet can be positioned against the primer of the next cartridge.

The bullet 16 is a generally cylindrical body, symmetrical in rotation about an axis 36, with a rear end 40 and a forward tip 42. The bullet has an exterior surface shaped as follows: A rear portion 44 has a tapered frustoconical "boat tail" surface; a cylindrical intermediate portion 46 continues forward from the rear portion with a straight cylindrical side wall that has a circumferential cannelure channel 50. Continuing, a forward ogive surface portion 52 has a gentle curve toward a meplat portion 54 at the tip. The meplat is a small diameter spherical portion. The ogive has a larger radius (as taken in a plane including the bullet's axis, as illustrated) than the intermediate section's diameter (taken in section across the axis), and also a much larger radius than that of the meplat, as will be quantified below.

The bullet is formed of a copper jacket 56 having a base portion 60, with side walls 62 extending forward to a rim 64 at a forward position on the ogive section, spaced apart from the meplat. The jacket closely surrounds a lead core 66 that defines a cylindrical cavity 70 in a forward face 72 of the core. The forward face is rearward of the jacket edge 64 in this particular embodiment, and the cavity is concentric with the axis 36.

The bullet tip is formed by a nose element 74 having a first shank portion 76 and a second tapered portion 80 formed as a unitary body of the same material. The shank portion is a cylindrical portion having a diameter equal to the diameter of the jacket rim, and which is closely received in the cavity of the core. The second portion has a larger diameter than the shank at its base adjacent to the shank. The base of the second portion forms a shoulder 82, and tapers to form the tip. The jacket rim tightly grips the base of the shank at the shoulder, to secure the nose into the bullet body.

The nose element is formed of a resilient material that elastically returns to its illustrated configuration after substantial compression. In the preferred embodiment, the resilient material is an elastomer with a Shore-A hardness of 80, such as Texin 285, an aromatic polyester-based thermoplastic polyurethane from Bayer MaterialScience AG, Leverkusen, Germany. The term "resilient" is used herein to distinguish from materials (including most thermoplastics and common ammunition metals such as copper or lead) that are essentially rigid, even if they will undergo slight elastic deformation from which they may recover without permanent distortion.

The hardness of the elastomer may vary from the preferred hardness. A lower limit is required to avoid a nose element that is so soft it does not withstand anticipated forces, and essentially allows the next cartridge to make a high energy strike against the jacket rim. In addition, too-soft material is more readily inadvertently removed from the bullet, which would result in a less-safe (and poor-performing) cartridge if used. A lower threshold hardness of Shore-A 60 is considered minimal, and a lower threshold of 70 is believed more suitable for most applications. If the material were too hard, it would generate concentrated forces at the tip that would behave in the unsafe manner of a conventional hard plastic or metal tip, with inadequate flexure to absorb energy and to compress into an adequately broad tip. An upper threshold hardness of Shore-A 95 is considered as a maximum, and a upper threshold of 85 is believed more suitable for most applications.

While a generally rigid plastic that may compress to less than 90% of its length without permanent deformation may in some senses be resilient, it is not considered resilient for the purposes of this disclosure, which contemplates substantial resiliency in the manner of an elastomer than can be compressed to less than 50% of its length repeatedly without permanent deformation. For this disclosure, "resilient" materials include rubber, silicone and any other synthetic or natural elastomer, as well as composite elements including more than one material, and/or with complex forms, including metal or other springs, compressible gas-filled bladders or bellows, and the like. Such elements may be used to construct a "resilient" nose element body, even when they include materials that would not be considered "resilient" if employed in monolithic form.

The essential function of the resilient nose is to prevent the discharge of the primer of the next cartridge 18 in the event the rifle is dropped on end, or in response to recoil forces. In the case in which a tubular-magazine rifle is dropped on the butt-stock, the entire mass of all the cartridges forward of the rearmost cartridge generates a substantial inertial force on the second-to-rearmost cartridge as it rests against the tip of the rearmost cartridge. If this force were concentrated over the small diameter of a metal-tipped bullet's meplat, or the meplat of a bullet tipped with a substantially rigid thermoplastic, this would generate a high force concentration that may be adequate to discharge a primer. However, in the preferred embodiment, the tip readily compresses to a broader, blunter tip, so that forces from recoil or a drop from a threshold height are distributed over a much broader area, limiting forces to a safe level below that needed for discharge. Under substantial force, the resilient tip of the preferred embodiment is believed to compress to an area of contact comparable to, or a significant percentage of that of the typical rifle primer.

Pointed plastic tips are common in rifle bullets. However, these are selected to be as rigid as possible, and not used in tube-magazine rifles. The rigidity is preferred to avoid damage to the tip during handling and loading, which will generally reduce accuracy by creating a non-uniform aerodynamic shape, and possibly introducing eccentricities in the bullet mass. Thus, the use of softer or more flexible materials is counter to the normal objectives of bullet design.

The use of a tapered or pointed tip provides a much higher ballistic coefficient than a conventional flat-tipped bullet normally required for tubular-magazine rifles. The overall shape with the resilient tip is that of a conventional high-performance spitzer, soft point hunting bullet, with a jacket that comes to an essentially sharp point (with a small meplat.) In alternative embodiments, the resilient tip and bullet shape may be selected to provide any desired bullet surface profile, using the tip as needed to alleviate the safety concerns discussed above.

In the illustrated embodiment, the example of a 30-30 Winchester cartridge is shown. The casing is a rimmed centerfire (not rimfire) design, although non-rimmed, rebated, and belted centerfire casings may also be employed. The bullet is elastomer tipped, 165 grains, lead core, and copper jacketed, with an overall length of 1.100", and an overall diameter of 0.308 inch. The length of the ogive section is 0.470 inch, and this section has an ogive radius of 1.50 inch. The exposed portion of the nose has a length of 0.101, which is 21% of the total ogive length. In alternative embodiments, a straight conical form would be considered to have a large radius of infinite amount, for purposes of comparing with other dimensions of the bullet. The meplat has a radius of 0.018 inch. The diameter of the meplat at the transition to the ogive section is about 0.030 inch, and the diameter of the largest portion of the ogive portion at the shoulder is 0.131 inch. This is a ratio of meplat diameter to ogive portion diameter of greater than 4, which provides a very aerodynamically efficient sharply pointed profile.

In alternative embodiments, a purely spherical resilient tip (all meplat) would be less aerodynamically efficient, and would have a ratio of 1, it would provide ballistic advantages over a flat tip as well as safety advantages over a conventional round tip. Preferably, the ratio is at least 1. The ratio of the ogive radius to the meplat radius is 37. If the tip surface were spherical, the ratio would be 1. Any ratio greater than 1 provides some aerodynamic benefits, but a ratio in excess of 3 is preferred. For a spire-point bullet having a straight conical forward portion terminated by a small meplat, (with part of the conic portion provided by the nose element) the straight portion is considered for the purposes of this disclosure to have an infinite ogive radius.

The diameter of the nose element at the base of the ogive portion (the same as the jacket forward rim diameter) must be large enough to provide safety, so that there is an adequate volume of resilient material to absorb the necessary energy based on a function of expected forces. For larger cartridges with heavier bullets, greater forces are expected, and thus the nose element diameter must be greater. The 30-30 cartridge with the 165 grain bullet has a ratio of nose element diameter to bullet diameter of 0.131/0.308 or 43%. A ratio of approximately 30 to 35% is considered minimum. For larger/heavier bullets, this ratio is generally greater.

In alternative embodiments, the tip may have any non-spherical shape and still be considered "pointed." Such shapes include those with parabolic, hyperbolic, conical or ellipsoidal sections, or any combination of these or other non-spherical surfaces of revolution. Certain bullets with a laterally flattened tip may also employ the resilient tip shape of the preferred embodiment, even though they are not surfaces of revolution.

In further alternatives, the resilient tip may have a flange or skirt that extends rearward of the shoulder, so that a forward jacket portion is closely covered by the skirt.

Figure 3:
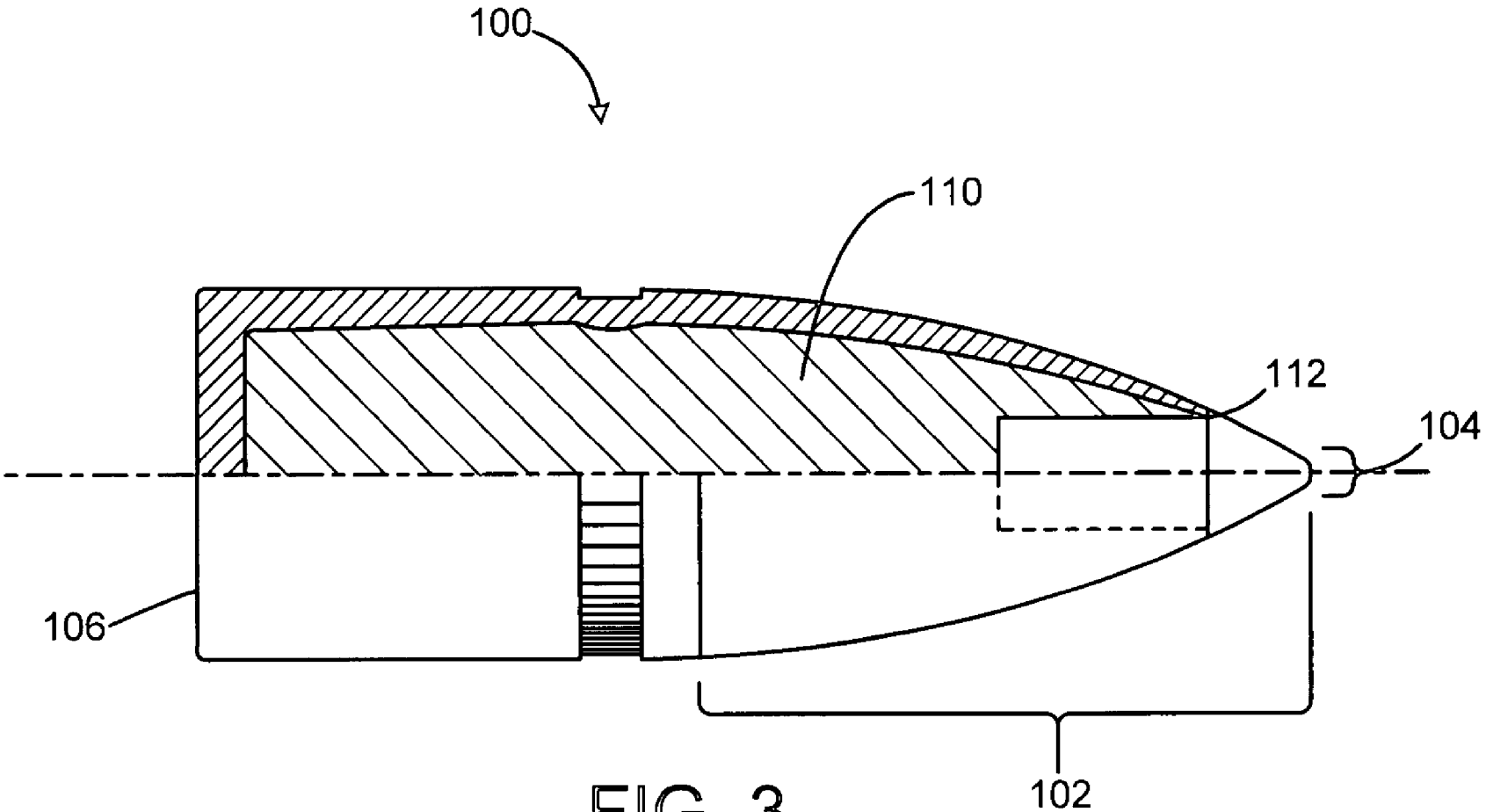
FIG. 3 is a sectional side view of a bullet according to a first alternative embodiment of the invention.

FIG. 3 shows a bullet 100 for the 35 Remington caliber. The bullet is elastomer tipped, 200 grains, lead core and copper jacketed, with an overall length of 1.030 inch, and an overall diameter of 0.358 inch. The length of the ogive section 102 is 0.560 inch, and this section has a ogive radius of 1.75 inches. The exposed portion of the nose has a length of 0.101, which is 18% of the total ogive length. The meplat 104 has a radius of 0.018 inch. The diameter of the meplat at the transition to the ogive section is about 0.030 inch, and the diameter of the largest portion of the ogive portion at the shoulder is 0.131 inch. This is a ratio of nose element diameter to bullet diameter, as mentioned above, of 37%. The bullet 100 has a flat base 106 without a boat tail, and the lead core 110 extends forward to just rearward of the forward rim 112 of the jacket.

Figure 4:
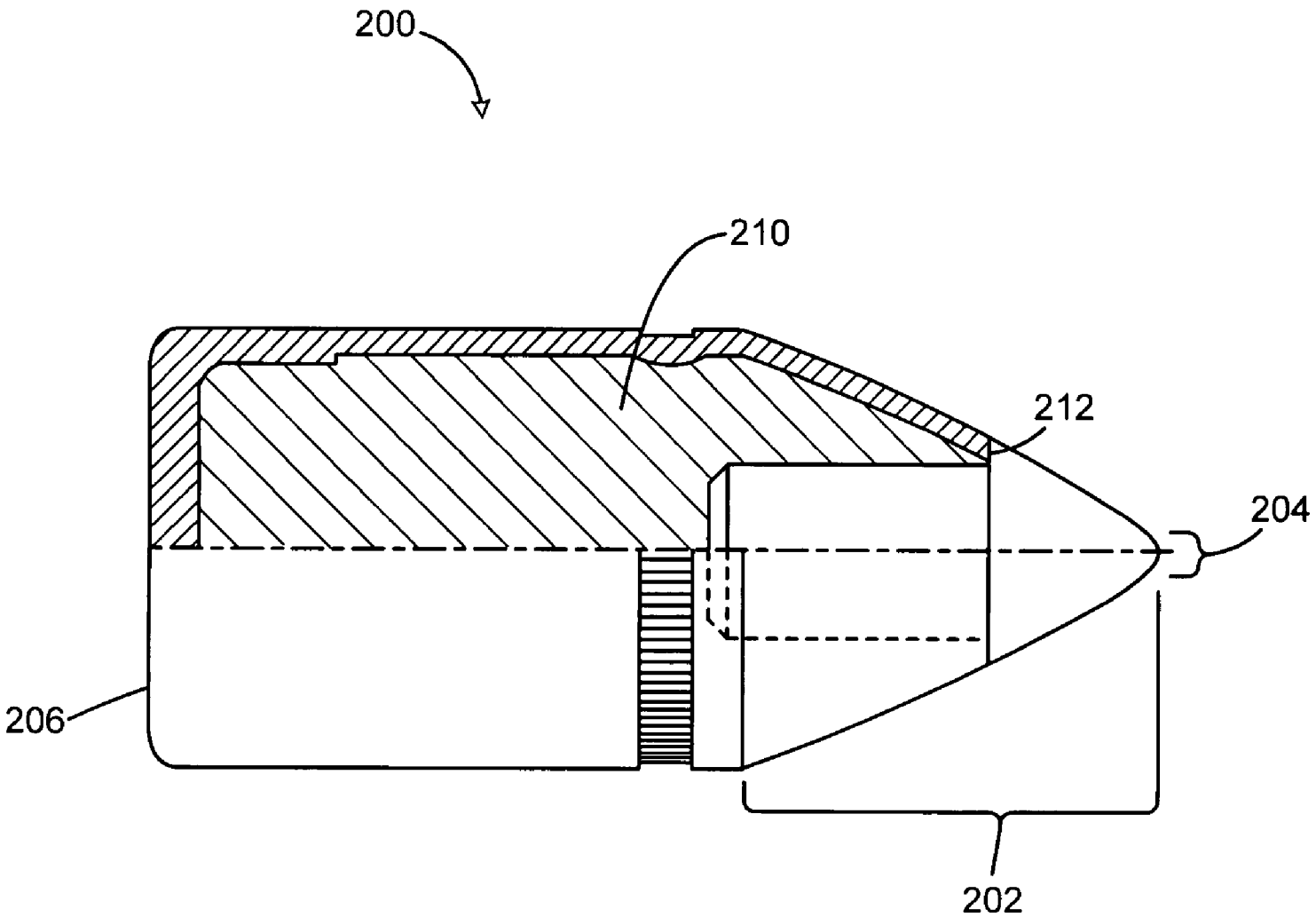
FIG. 4 is a sectional side view of a bullet according to a first alternative embodiment of the invention.

FIG. 4 shows a bullet 200 for the 45-70 or 450 Marlin calibers. The bullet is elastomer tipped, 325 grains, lead core and copper jacketed with an overall length of 1.050 inches, and an overall diameter of 0.458 inch. The length of the ogive section 202 is 0.400 inch, and this section has an ogive radius of 1.50 inches. The exposed portion of the nose has a length of 0.173, which is 43% of the total ogive length. The meplat 204 has a radius of 0.02 inch. The diameter of the meplat at the transition to the ogive section is about 0.035 inch, and the diameter of the largest portion of the ogive portion at the shoulder is 0.235 inch. This is a ratio of nose element diameter to bullet diameter of 51%. The bullet 200 has a flat base 206 without a boat tail, and the lead core 210 extends forward nearly to the forward rim 212 of the jacket.

The performance advantages provided by the sleek or pointed shapes generated by the resilient tips are comparable to the performance of plastic or metal tipped bullets of the same shape.

While the above is discussed in terms of preferred and alternative embodiments, the invention is not intended to be so limited.

The invention claimed is:

1. A firearm ammunition component comprising:
an elongated body;
the body having a forward end;
the body having a rear end opposite the forward end;
the body having an intermediate cylindrical portion between the rear and forward ends;
the front end of the body defining a cavity;
a resilient pointed nose element having a first portion received in the cavity; and
the nose element having a second portion extending from the forward end of the body.

2. The component of claim 1 wherein the nose element is an elastomer.

3. The component of claim 1 wherein the nose element has a Shore-A hardness of at least 60.

4. The component of claim 1 wherein the nose element has a Shore-A hardness of at most 95.

5. The component of claim 1 wherein the cavity is a cylindrical bore.

6. The component of claim 1 wherein the second portion of the nose element is tapered.

7. The component of claim 1 wherein a forward portion of the body has a tapered surface portion, and wherein the second portion of the nose element has an external surface portion extending smoothly from the tapered surface portion.

8. The component of claim 7 wherein the tapered surface portion of the body and the external surface portion of the nose element have a common ogive radius.

9. The component of claim 1 including a case defining an interior volume containing gunpowder, and defining a case mouth receiving the body.

10. The component of claim 1 wherein the body includes a lead core surrounded by a copper jacket, and wherein the copper jacket has a forward aperture extending to the second portion of the nose element and closely receiving a forward portion of the first portion of the nose element.

11. The component of claim 1 wherein the intermediate cylindrical portion defines the maximum diameter of the component.

12. A firearm ammunition component comprising:
an elongated body;
the body having a forward end;
the body having a rear end opposite the forward end;
the body having an intermediate cylindrical portion between the rear and forward ends;
the front end of the body defining a central aperture communicating with a single cavity;
an elastomeric nose element having a fast portion received in the cavity; and
the nose element having a pointed second portion extending from the forward end of the body.

13. A firearm cartridge comprising:
a case defining an interior volume containing gunpowder, having a rear end defining a central primer pocket receiving a primer, and defining a case mouth at a forward end opposite the rear end;
a bullet received in the case mouth;
the bullet having a tapered forward portion extending from the case;
at least a first portion of the forward portion comprising a resilient nose element; and
the bullet having a unitary core defining a cavity, with a portion of the nose element being received in the cavity.

14. The cartridge of claim 13 wherein the nose element has a tip having a limited first radius, and wherein the bullet includes a body receiving a portion of the nose element, the nose element having a surface portion adjacent to the body and away from the tip, the surface portion having a second radius greater than the first radius.

15. The cartridge of claim 13 wherein the nose element is an elastomer.

16. The cartridge of claim 13 wherein a portion of the nose element has an external surface portion adjacent to and extending smoothly from the forward portion of the bullet.

17. A firearm ammunition component comprising:
an elongated body;
the body having a forward end;
the body having a rear end opposite the forward end;

the body having an intermediate cylindrical portion between the rear and forward ends;

the body defining a cavity having a forward opening;

a resilient pointed nose element having a first portion received in the cavity;

the nose element having a second portion extending from the forward end of the body;

the second portion of the nose element including a curved ogive portion having a first radius of curvature and abutting the forward end of the body, and a meplat portion having a different second radius of curvature and forming a tip.

18. The component of claim 17 wherein the ogive portion has an ogive radius of curvature, the meplat portion has a meplat radius of curvature, and the ogive radius of curvature is greater than the meplat radius of curvature.

19. The component of claim 17 wherein the ogive has a first diameter at an ogive rear portion adjacent to the body, and a lesser second diameter adjacent to the meplat.

20. The component of claim 17 wherein the nose element defines an axis, and wherein the ogive portion has a first radius of curvature along the axis, and a lesser second radius of curvature across the axis.

* * * * *